US006780469B2

(12) United States Patent
Iijima et al.

(10) Patent No.: US 6,780,469 B2
(45) Date of Patent: Aug. 24, 2004

(54) NUBUCK-LIKE ARTIFICIAL LEATHER AND A PRODUCTION PROCESS THEREOF

(75) Inventors: Hiromichi Iijima, Shiga (JP); Koji Watanabe, Shiga (JP)

(73) Assignee: Toray Industries, Inc. (JP)

( * ) Notice: Subject to any disclaimer, the term of this patent is extended or adjusted under 35 U.S.C. 154(b) by 132 days.

(21) Appl. No.: 10/078,218

(22) Filed: Nov. 7, 2001

(65) Prior Publication Data

US 2002/0081418 A1 Jun. 27, 2002

Related U.S. Application Data

(62) Division of application No. 09/341,199, filed on Jul. 6, 1999, now abandoned.

(30) Foreign Application Priority Data

Nov. 7, 1997 (JP) ..... 9-305669
Sep. 7, 1998 (JP) ..... 10-252295

(51) Int. Cl.[7] ..... B05D 3/12
(52) U.S. Cl. ..... 427/336; 427/352; 427/353; 427/355; 427/369; 427/430.1
(58) Field of Search ..... 427/336, 430.1, 427/369, 352, 353, 355

(56) References Cited

U.S. PATENT DOCUMENTS 4,018,954 A * 4/1977 Fukushima et al. ..... 428/86
4,206,257 A * 6/1980 Fukushima et al. ..... 428/91
4,587,142 A 5/1986 Higuchi et al. ..... 428/15
5,256,429 A 10/1993 Honda et al. ..... 428/225
6,451,716 B1 * 9/2002 Sasaki et al. ..... 442/77

FOREIGN PATENT DOCUMENTS

JP 7-133592 5/1995

* cited by examiner

*Primary Examiner*—Shrive P. Beck
*Assistant Examiner*—Kirsten Crockford Jolley
(74) *Attorney, Agent, or Firm*—Piper Rudnick LLP

(57) ABSTRACT

The present invention relates to an artificial leather having nap very little oriented on the surface and having short fibers densely, and hence having a good nubuck-like look and hand, and also relates to a production process thereof. The present invention provides an artificial leather having a nap surface of ultra-fine fibers at least on one side, which is formed by applying an elastic polymer to an ultra-fine fiber-entangled substrate, characterized by being 0.3 g/cm$^3$ or more in the apparent density of the artificial leather, being 0.5 mm or less in the nap length, and being 25% or less in the R value obtained from the goniometric reflectance distribution measured with the nap surface rotated from 0 degree to 180 degrees using a goniophotometer. The present invention also provides a process for producing a nubuck-like artificial leather, in which a sheet obtained by applying an elastic polymer to an ultra-fine fiber-entangled substrate is raised to produce a napped sheet, comprising the steps of applying an elastic polymer to an ultra-fine fiber-entangled substrate, substantially solidifying the elastic polymer, immersing the polymer-deposited fiber-entangled substrate into a swelling agent of the elastic polymer, to swell the elastic polymer, compressing the sheet in the normal direction of the sheet, removing the swelling agent by an aqueous solvent, and raising the sheet at least on one side.

6 Claims, 3 Drawing Sheets

NUBUCK-LIKE ARTIFICIAL LEATHER AND A PRODUCTION PROCESS THEREOF

This application is a divisional of application Ser. No. 09/341,199, filed Jul. 6, 1999, now abandoned, incorporated herein by reference.

TECHNICAL FIELD

The present invention relates to an artificial leather which looks like nubuck, and a production process thereof.

In more detail, the present invention relates to an artificial leather having a less oriented surface nap and having short densely packed nap fibers, hence having a nubuck-like look and hand, and also relates to a production process thereof.

BACKGROUND ARTS

In recent years, techniques for producing artificial leathers having nap produced from synthetic ultra-fine fiber-entangled substrates and elastic polymers have made rapid progress, and those artificial leathers are being widely accepted in the fields of high quality fashion, car sheets, interior, furniture, etc.

These artificial leather production techniques can be said to have shown remarkable progress especially in the area of suede-like artificial leathers, etc. Since these artificial leathers have many ultra-fine fibers raised on the surfaces, the following problem arises at the time of sewing, etc.

Since the nap of a finally produced fabric is highly oriented, a product obtained by sewing plural fabric pieces different in nap orientation visually shows a large color shade difference on the differently oriented nap surfaces. So, to prevent such a difference, it is necessary to sew only the fabric pieces with the same nap orientation together. For this reason, the fabric pieces cannot be effectively used, and there is a limit in the sewing yield.

The visually large color shade difference depending on the observation direction is more likely to be accepted in the artificial leather area in favor of longer nap since it provides a feeling of high quality, but on the other hand, in the artificial leather area in favor of shorter and denser nap like nubuck, such a large color shade difference is less likely to be accepted.

Because of the above problem, it is demanded that an artificial leather with a nap surface small in visual color shade difference depending on the observation direction and good in sewing yield is developed.

Such an artificial leather with small visual color shade difference in the nap surface depending on the observation direction is essentially more suitable for the nubuck-like artificial leather area rather than for the suede-like artificial leather area, if the nap is shorter and denser.

In the conventional production of artificial leathers consisting of ultra-fine fibers and elastic polymers, several techniques for shortening and densifying the nap raised on the surface are known.

For example, Japanese Patent Laid-Open (Kokai) No. Hei7-126986 describes a method comprising the steps of slitting a sheet composed of ultra-fine fibers and an elastic polymer, coating the slit surface with a solution containing a solvent of the elastic polymer, and buffing the surface coated with the solvent-containing solution.

Furthermore, Japanese Patent Laid-Open (Kokai) No. Hei7-126985 proposes a method comprising the steps of impregnating a conjugate fiber sheet with an elastic polymer, partially squeezing the elastic polymer in the normal direction from the surface of the substrate, coagulating, making the conjugate fibers ultra-fine, applying a solvent of the elastic polymer to the non-raised surface, coagulating, and buffering the solvent-applied surface.

The former method has a problem that it is difficult to control the degree of solution impregnation in the normal direction of the sheet, and the latter method has a problem that it is difficult to control the squeezed amount when the sheet thickness fluctuates due to various reasons. As a result, though the denseness of the nap improves, the nap length is likely to be uneven, depending on the degree of buffing, and furthermore, though the nap length can be shortened since the adhesive strength between the ultra-fine fibers and the elastic polymer increases, there is another problem that the product looks less soft on the other hand.

DISCLOSURE OF THE INVENTION

A first object of the present invention is to provide an artificial leather with a nap surface small in visual color shade difference and good in sewing yield. With the successful development of the artificial leather, an unprecedentedly visually excellent nubuck-like artificial leather is intended to be provided.

A second object of the present invention is to provide a process for allowing the production of the above artificial leather, particularly the unprecedentedly visually excellent nubuck-like artificial leather.

A third object of the present invention is to provide a process for allowing the production of the above artificial leather, particularly a nubuck-like artificial leather having a soft hand and having a nap surface very small in visual color shade difference.

The nubuck-like artificial leather of the present invention to achieve the first object of the present invention is as follows.

An artificial leather having a nap surface of ultra-fine fibers at least on one side, which is formed by applying an elastic polymer to an ultra-fine fiber-entangled substrate, characterized by being 0.3 g/cm$^3$ or more in the apparent density of the artificial leather, being 0.5 mm or less in the nap length, and being 25% or less in the value obtained from the following formula based on the goniometric reflectance distribution measured with the nap surface rotated from 0 degree to 180 degrees using a goniophotometer.

$$R \text{ value } (\%)=(R1-R3)/(R1-R2)\times 100$$

(where R1 is the quantity of reflected light at 0 degree; R2 is the minimum quantity of reflected light in a range from 0 to 180 degrees; and R3 is the quantity of reflected light at 180 degrees).

The process for producing a nubuck-like artificial leather of the present invention to achieve the second object of the present invention is as follows:

A process for producing a nubuck-like artificial leather, in which a sheet obtained by applying an elastic polymer to an ultra-fine fiber-entangled substrate is raised to produce a napped sheet, comprising the steps of applying an elastic polymer to an ultra-fine fiber-entangled substrate, substantially solidifying the elastic polymer, immersing the polymer-deposited fiber-entangled substrate into a swelling agent of the elastic polymer to swell the elastic polymer, compressing the sheet in the normal direction of the sheet, removing the swelling agent by an aqueous solvent, and raising the sheet at least on one side.

The process for producing a nubuck-like artificial leather to achieve the third object of the present invention is according to the above process, wherein the constraint at the nap base is eased before or after nap raising, for making the nap less oriented, by caustic reducing the ultra-fine fibers or rubbing the nap raised fabric as a whole.

The above artificial leather and the production process thereof of the present invention can provide an artificial leather with a small visual color shade difference in the nap surface and good in the sewing yield, hence an unprecedentedly visually excellent nubuck-like artificial leather, and also a production process thereof.

THE BEST EMBODIMENTS OF THE INVENTION

The nubuck-like artificial leather of the present invention and the production process thereof are described below in detail.

The inventors studied intensively to solve the above problem, i.e., the problem in sewing attributable to the surface gloss difference depending on the orientation of the nap, for developing an artificial leather improved in sewing yield, and found that the problem can be solved by specifying the reflection of light from the nap surface, i.e., by keeping the surface gloss difference as small as possible, and also found that an unprecedentedly good nubuck-like artificial leather can be obtained.

The nubuck-like artificial leather of the present invention is characterized by being 25% or less in the R value obtained from the goniometric reflection distribution measured by rotating the nap surface from 0 degree to 180 degrees using a goniophotometer, as described above.

The R value is described below.

In general, an artificial leather with a nap surface of ultra-fine fibers at least on one side obtained by applying an elastic polymer to an ultra-fine fiber-entangled substrate has the nap raised usually by buffing the surface of the sheet in the longitudinal direction, for example, using sand paper in the raising process. In this case, the nap is oriented in the buffing direction. The direction in which the nap is likely to fall when the nap surface is brushed is defined as the forward direction, and the direction in which the nap is likely to be raised is defined as the reverse direction.

Figure 1:
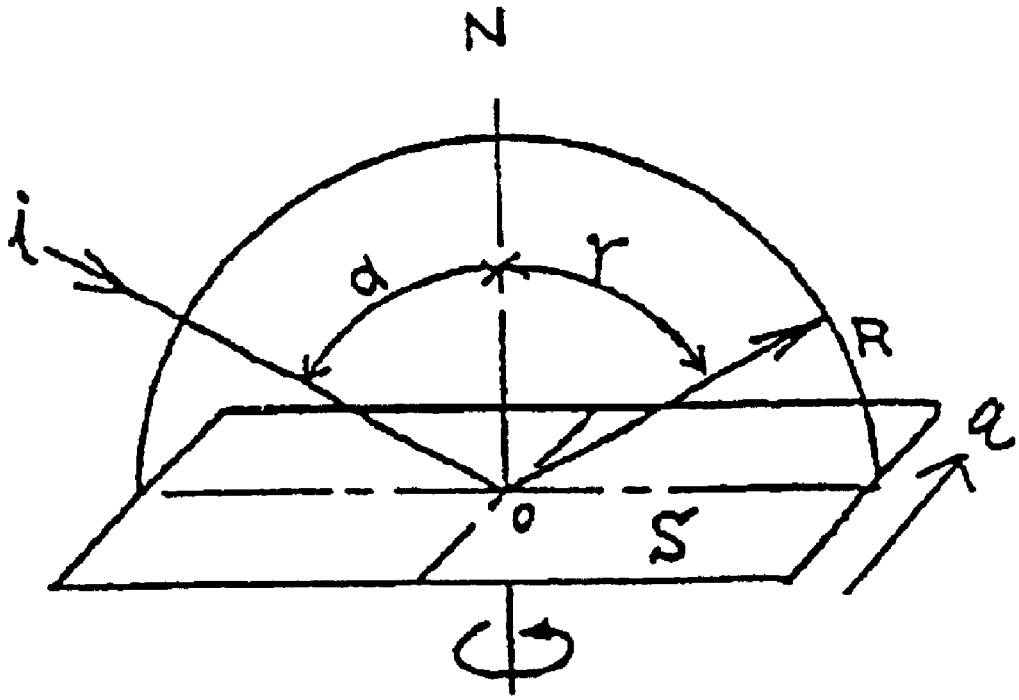
FIG. 1 is a schematic model diagram for illustrating the method for measuring the goniometric reflectance distribution in the present invention.

The method for measuring the goniometric reflection distribution in the present invention is described below in reference to the model diagram shown in FIG. 1.

At first, a goniophotometer (Model GP-1R or GP-200) with a halogen lamp (12 V, 50 W) installed as a light source lamp is used, and the incident light (i) is turned toward the central point (0) at an angle of incidence ($\alpha$) of 60 degrees against the normal (N) of the surface of an artificial leather (S) and with the receiving angle ($\gamma$) of the reflected light (R) as 60 degrees. On the other hand, nylon filaments (210D-15f, produced by Toray Industries, Inc.) are used to form a double pile fabric consisting of 85 warp threads per inch and 57 weft threads per inch, having 594 piles per 25 mm with a pile length of 2.6 mm (thickness from the back of the fabric to the tips of piles), and the fabric is heat-set and has the piles inclined in one direction, as a brush fabric. It is stuck and fixed to a 400 g load with a 10 cm long×10 cm wide flat surface, and the laminate is placed on the nap surface of an artificial leather and driven to rub in the forward direction of the nap at a speed of 5 m/second. This operation is repeated 5 times to make a specimen.

The above condition is close to a condition in which dust deposited on clothes is removed using a clothes brush. This specimen is set as shown in FIG. 1, with the forward direction (a) of the nap kept perpendicular to the incident light (i). The angle of the specimen in this position is 0 degree.

In this state, a source light is applied and at the same time, the artificial leather is continuously rotated in the direction of the arrow by 180 degrees, to measure the reflected light (R) continuously to obtain the goniometric reflectance distribution.

In this case, the quantity of reflected light on the goniometric reflectance distribution becomes different depending on the hue of the artificial leather, even though the quantity of incident light is the same. Therefore, the R value (%) of the present invention is obtained under the following reference conditions.

At first, a magnesium fluoride white plate is used to adjust the full scale at 100% using a luminous quantity control and the sensitivity control of the goniophotometer. Then, if a dark colored artificial leather is, for example, set under the above conditions, the quantity of reflected light varies at low positions as a matter of course. If a light colored artificial leather is set under those conditions, the quantity of reflected light varies at positions higher than those of the dark colored artificial leather as a matter of course.

Figure 2:
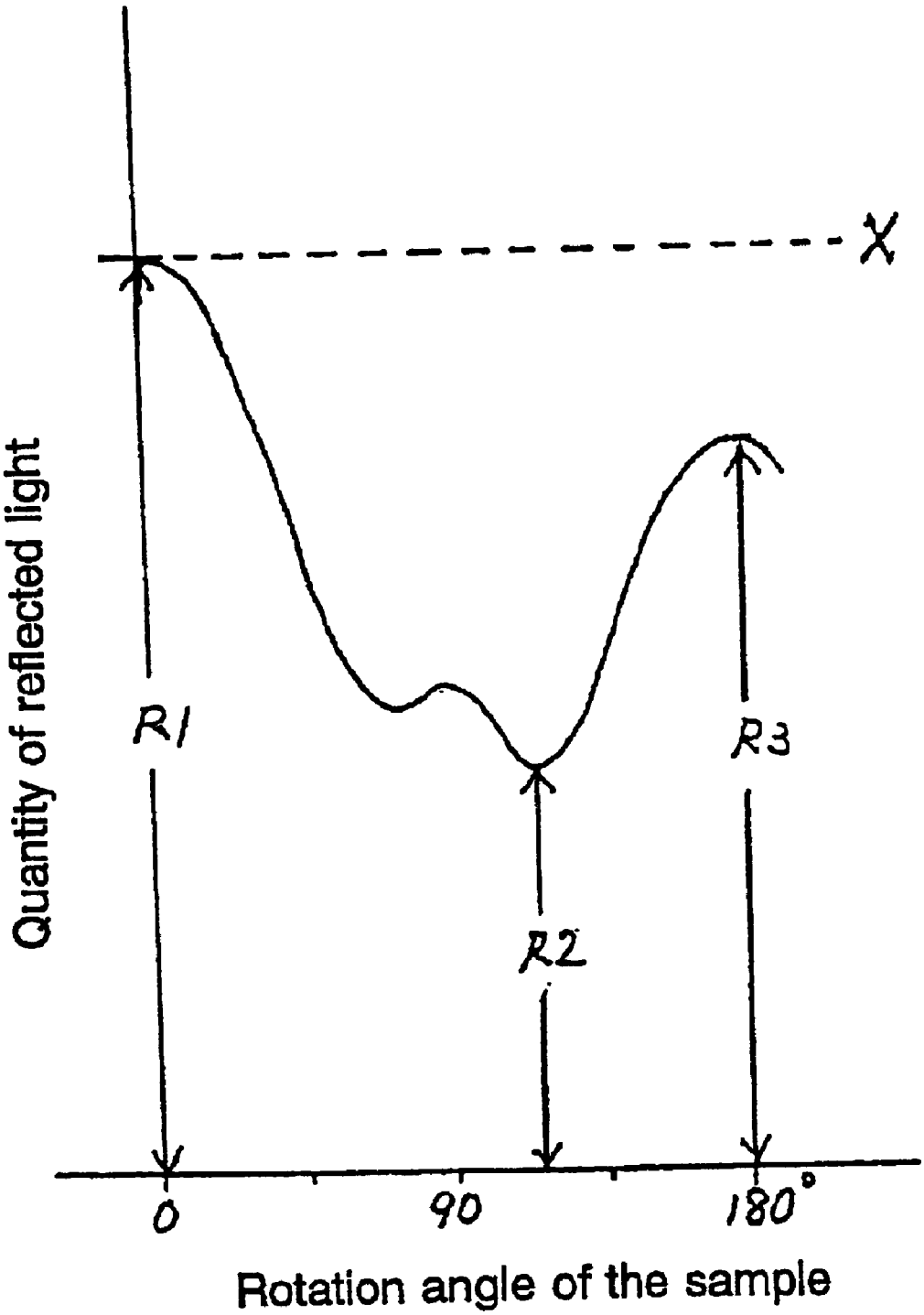
FIG. 2 shows an example of the goniometric reflectance distribution shown by a conventional artificial leather.

To eliminate the difference due to the hue of an artificial leather for evaluation in reference to the same criterion, the luminous quantity control and the sensitivity control of the goniophotometer are adjusted to ensure that the quantity of reflected light with the forward direction (a) of the nap kept perpendicular to the incident light (i) (with the specimen angle set at 0 degree) comes at the 50% position (X) of the magnesium fluoride white sheet. Then, measurement is initiated to obtain the goniometric reflectance distribution as shown in FIG. 2. This is used to obtain the R value (%) from the following formula. However, since an artificial leather is also somewhat irregular on the surface, five specimens are measured, and their mean value is obtained.

$$R \text{ value } (\%) = (R1 - R3)/(R1 - R2) \times 100$$

(where R1 is the quantity of reflected light at 0 degree; R2, the minimum quantity of reflected light in a range from 0 to 180 degrees; and R3, the quantity of reflected light at 180 degrees).

A further detailed description will be made in reference to an example of the goniometric reflectance distribution.

R1 in the present invention indicates R1 on the goniometric reflectance distribution of FIG. 2, that is, the quantity of reflected light when the source light falls on the nap in the forward direction at 90 degrees. R2 indicates the lowest quantity of reflected light when the artificial leather is continuously rotated at a constant speed in the arrow direction of FIG. 1 till 180 degrees. R3 indicates the quantity of reflected light at the position of 180-degree rotation, i.e., where the orientation of the nap becomes quite contrary to that at R1.

The inventors found that when the R value (%) as the luminous quantity difference of (R1−R3) with the luminous quantity difference of (R1−R2) as 100% on the goniometric reflectance distribution is 25% or less, preferably 20% or less, more preferably 15% or less, the gloss difference of the nap surface is small. Hence, the visual color shade difference is small even if the fabric pieces different in orientation are sewn together. Therefore, the fabrics can be effectively used to improve the sewing yield. The inventors also found that it is preferable that the R value (%) of the nubuck-like artificial leather of the present invention is 0.1% or more, more preferably 0.5% or more. If the R value (%) is too small, the artificial leather looks visually poor.

In the present invention, the ultra-fine fiber-entangled substrate can be obtained, for example, by forming conjugate fibers by conjugated spinning or polymer blended spinning of at least two polymers different in nature or forming ultra-fine fibers by direct spinning of a single polymer, forming them into a web, converting it into a nonwoven fabric by any entangling means such as needle punching or water jet punching, dissolving away at least one polymer in the case of conjugate fibers, or physically or chemically peeling or splitting, to make ultra-fine fibers.

The conjugate fibers and ultra-fine fibers are not especially limited in form, and it is only required that an ultra-fine fiber-entangled substrate can be obtained.

As regards the conjugate fibers, the polymers which can be used to form the ultra-fine fibers include polyamides such as nylon 6, nylon 66, nylon 12 and nylon copolymers, and polyesters such as polyethylene terephthalate, polyethylene terephthalate copolymers, polybutylene terephthalate, polybutylene terephthalate copolymers, polypropylene terephthalate and polypropylene terephthalate copolymers, and the polymers which can be used to be dissolved away or physically or chemically peeled or split include said polyamides, polyesters, and polyolefins such as polyethylene, polystyrene and polypropylene. Polymers can be selected from them for combination, considering the section formability, spinnability, stretchability, etc. of ultra-fine fibers.

Especially as described later, since the sheet of the present invention is often softened by an alkali (caustic reduction treatment), an alkali soluble polymer which is soluble in alkalis and insoluble in the solvent of the elastic polymer can be preferably used as one polymer of the conjugate fibers. It is especially preferable that the alkali soluble polymer is a co-polyester mainly composed of terephthalic acid and ethylene glycol, and containing 6 to 12 molt of 5-sodiumsulfoisophthalic acid and/or 0 to 10 mol % of isophthalic acid, respectively based on the total amount of the acids.

The polymer for forming the ultra-fine fibers can also contain such additives as a light resisting agent, pigment, deluster, electricity controlling agent and flame retardant.

The ultra-fine fibers of the present invention can be single fibers, but fiber bundles respectively consisting of plural fibers are preferable. It is preferable that the number of fibers of each fiber bundle is at least 5 or more, more preferably 15 or more, and especially preferably 30 or more. The reason is that if the number of fibers constituting each bundle is larger, a denser nap structure can be formed. It should be noted that the preferable number of fibers depends on the fineness of fibers.

It is preferable that the average fineness of ultra-fine fibers is in a range of 0.001 dtex to 0.1 dtex in view of the hand, surface touch, color developability, nap denseness described later, etc. of the nubuck-like artificial leather.

If the average fineness of ultra-fine fibers is larger within the range, it is desirable that the number of the fibers constituting each ultra-fine fiber bundle is smaller, and if the average fineness of ultra-fine fibers is smaller within the range, it is desirable that the number of the fibers constituting each ultra-fine fiber bundle is larger.

If the average fineness of the ultra-fine fibers is less than 0.001 dtex, the strength of the fibers decline, and the nap may be likely to be cut by buffering. If more than 0.1 dtex, it becomes hard to cut the nap short uniformly on the contrary, and irregular nap may occur, not allowing the effect of the present invention to be achieved.

A preferable average fineness range of the ultra-fine fibers is 0.005 dtex to 0.05 dtex.

The base material of the artificial leather of the present invention is obtained by applying an elastic polymer to an ultra-fine fiber-entangled substrate.

The elastic polymer is not especially limited. For example, a polyurethane can be typically used, and furthermore one or more in combination of polyester diol based polyurethanes, polyether diol based polyurethanes, polycarbonate diol based polyurethanes, etc. can be preferably used in view of the hand and surface touch of the artificial leather. The elastic polymer can also contain such additives as a colorant, antioxidant, antistatic agent, dispersing agent, softening agent and coagulation regulator.

Figure 3:
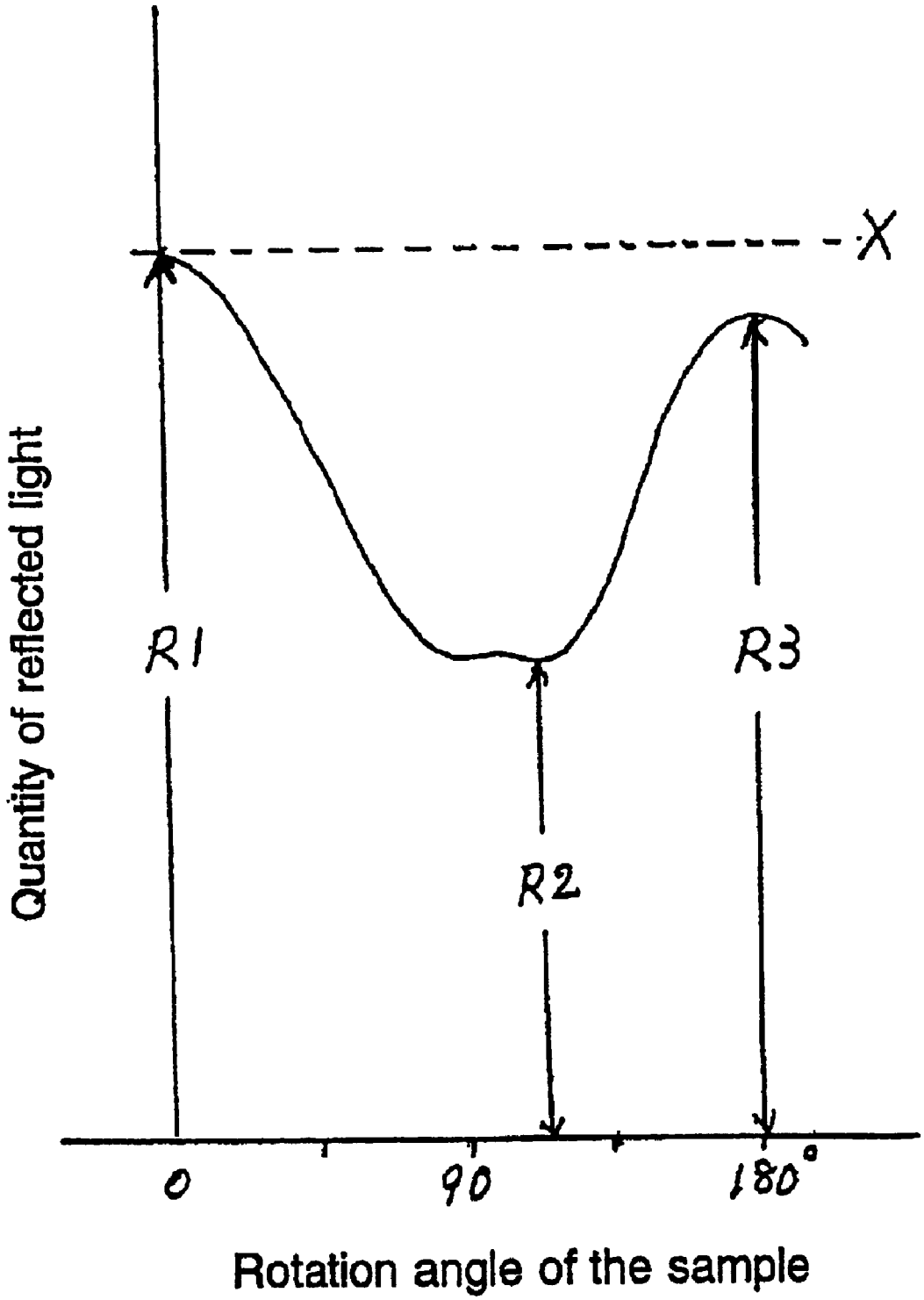
FIG. 3 is an example of the goniometric reflectance distribution shown by the nubuck-like artificial leather of the present invention.

Preferable features of the nubuck-like artificial leather of the present invention are that the R value (%) is 25% or less as shown in FIG. 3, and that it little has the two remarkable troughs in the change of the quantity of reflected light at about 90 degrees on the reflectance distribution shown in FIG. 2 when its surface is rotated by about 90 degrees. This suggests that the preferable artificial leather of the present invention hardly shows the change of the quantity of reflected light at about 90 degrees, and is unlikely to cause the color shade difference.

It is important the nubuck-like artificial leather of the present invention has a high apparent density as the artificial leather as a whole and is kept as rich as possible in the fibers on the surface. As a rule of thumb, a density of 0.3 g/cm$^3$ or more is necessary, and 0.4 g/cm$^3$ or more is preferable. The apparent density refers to a value obtained by dividing the areal unit weight of the artificial leather by its thickness. The high apparent density of the artificial leather as a whole makes the apparent density of the ultra-fine fibers higher, and this is important for obtaining the denseness of nubuck-like nap.

The method for increasing the apparent density of the artificial leather as a whole is described later in detail in the process for producing the artificial leather of the present invention.

If the apparent density of the artificial leather is less than 0.3 g/cm$^3$, the artificial leather generally tends to have the nap more regularly oriented and tends to have the elastic polymer exposed on the surface, which tends to cause the two troughs in the change of the quantity of reflected light at about 90 degrees on the reflectance distribution shown in FIG. 2. Hence, it is likely to show a visual color shade difference. Such a low apparent density is unacceptable in the present invention.

The quantity of reflected light generally changes depending on the nap on the surface of the artificial leather. The nap on the surface of the artificial leather can be obtained by buffing a sheet with an elastic polymer applied to an ultra-fine fiber-entangled substrate, at least on one side using, for example, sand paper. To make the present invention more effective, it is important that the nap of ultra-fine fibers is more uniformly short.

The length of nap refers to the length from the bottom to the top of the nap laid down by brushing the nap surface.

Any brush which can open and lay down the nap can be used. In the artificial leather of the present invention, it is important that the length is 0.5 mm or less. If the nap length is more than 0.5 mm, the nap is more regularly oriented, and the R value (%) tends to be large, making it difficult to obtain the nubuck-like artificial leather of the present invention.

It is also preferable that the nap length of the ultra-fine fibers is uniform, much like the piles of velvet, and shorter than in velvet. The nap in this state can be obtained by using the following means in any proper combination for raising: increasing the buffing speed, using sand paper with finer abrasive grains, increasing the adhesiveness between the ultra-fine fibers and the elastic polymer before buffing, coating the sheet surface with inorganic fine grains by brushing for increasing the frictional resistance and buffering at a high speed, etc.

It is essentially necessary that the artificial leather of the present invention has nap of ultra-fine fibers and that the nap length is 0.05 mm or more. A preferable nap length range is 0.1 mm to 0.5 mm, and a more preferable range is 0.1 mm to 0.4 mm. If the nap length is less than 0.05 mm, the leather-like appearance is lost.

As a general trend, if the number of ultra-fine fibers is larger and the nap length is shorter, then the artificial leather tends to be poor in hand and touch.

To control the above trend, for obtaining a nubuck-like artificial leather with a good hand and touch, it is effective, for example, that if the polymer forming the ultra-fine fibers is a polyester or co-polyester, the ultra-fine fibers are treated by caustic reduction using an alkali solution before or after dyeing, to form voids among the fibers of the nap, for thinning the fibers at the top of the nap. If the polymer forming the ultra-fine fibers is a polyamide, it is effective to pre-treat by a swelling agent and to physically rub in the step of dyeing.

The caustic reduction treatment or the physical rubbing treatment can ease the constraint at the base of the nap, and as a result, the nap can be eased in orientation, to lower the R value (%).

The process for producing the nubuck-like artificial leather of the present invention is described below.

The nubuck-like artificial leather of the present invention can be produced by a process, in which a sheet obtained by applying an elastic polymer to an ultra-fine fiber-entangled substrate is raised into a napped sheet as practiced conventionally for producing an artificial leather, comprising the steps of applying an elastic polymer to an ultra-fine fiber-entangled substrate, substantially solidifying the elastic polymer, immersing the polymer-deposited fiber-entangled substrate into a swelling agent of the elastic polymer, compressing the sheet in the normal direction of the sheet, removing the swelling agent by an aqueous solvent, and raising at least on one side.

At first, an ultra-fine fiber-entangled substrate or a conjugate fiber-entangled substrate capable of producing ultra-fine fibers by any later ultra-fine fiber forming means is produced in the present invention. For example, to produce the ultra-fine fiber-entangled substrate, ultra-fine fibers are shortened to 15 mm or less and formed into a web by a paper making technique, and the web is punched by water jet, to produce a fiber-entangled substrate. As another method, a long fiber-entangled substrate can be produced by melt blow method. Other methods include the sheet being punched by needles or water jet, etc., to make a fiber-entangled substrate.

On the other hand, a conjugate fiber-entangled substrate can be produced by shortening conjugate fibers, forming a web according to a conventional method such as a card crosslapper method, random webber method or melt blow method, forming a sheet of conjugate fibers by needle punching, and making the conjugate fibers ultra-fine by a solvent, heat treatment or mechanical treatment, etc.

Then, in the present invention, an elastic polymer is applied to the fiber-entangled substrate. However, before the elastic polymer is applied, it is preferable to heat-treat the fiber-entangled substrate for shrinking, or to pressurize it using a roll or plate with heating, or to pressurize it in a wet state by a so-called wet press, respectively, for densifying the fiber-entangled substrate, or applying a size such as polyvinyl alcohol, for shape integration, since the product grade can be improved.

The structure of the fiber-entangled substrate is generally a structure of three-dimensionally entangled ultra-fine fibers as described above, and a thinner substrate of this structure may not be able to be used depending on applications, since the strength is too low.

As an embodiment for solving the problem of low strength, it is especially preferable to use an ultra-fine fiber-entangled substrate and a woven fabric and/or knitted fabric together, as an integrated fiber-entangled substrate.

The fiber-entangled substrate integrated with a woven fabric and/or knitted fabric can be obtained, for example, by overlaying the above mentioned web of ultra-fine fibers or conjugate fibers on a woven fabric and/or knitted fabric, and combining them by needle punching or water jet punching.

The integrated fiber-entangled structure can be produced by overlaying a woven fabric and/or knitted fabric on one or both sides of a web, and entangling them, or by overlaying a woven fabric and/or knitted fabric on one side of the web, entangling them to produce an integrated fiber-entangled structure, overlaying a plurality of such integrated fiber-entangled structures, and cutting the entire integrated structure into halves in the direction parallel to the surface (to produce two sheets with one half thickness of the original sheet).

In this embodiment, the yarns used to form the woven fabric or knitted fabric can be filament yarns, spun yarns or blended yarns consisting of filaments and short fibers, etc., and are not especially limited.

The woven fabric or knitted fabric can be a warp knitted fabric, weft knitted fabric such as tricot fabric, or any of various knitted fabrics derived from these basic knitted fabrics, or plain weave fabric, twill weave fabric, satin weave fabric and any of various woven fabrics derived from these basic woven fabrics, and is especially not limited.

When a web of ultra-fine fibers or conjugate fibers is firmly entangled with a woven fabric or knitted fabric by needle punching, the yarns used in the woven fabric or knitted fabric may be cut, depending on the kind of yarns used. To prevent it, it is preferable that such yarns are high twisted yarns.

It is preferable that the count of twist of the high twisted yarns is 500 T/m to 4500 T/m. A more preferable range is 1500 T/m to 4500 T/m, and the most preferable range is 2000 T/m to 4500 T/m. If the count of twist is less than 500 T/m, since the single fibers constituting the yarns are insufficiently tightened together, the fibers are likely to be caught by the needles when the fiber-entangled substrate is formed, and are likely to be damaged. If the count of twist is too large, the yarns are too hard in view of the soft hand of the product. Thus, it is desirable that the count of twist is 4000 T/m or less.

It is preferable that the woven fabric or knitted fabric at least partially uses the high twisted yarns. It is especially preferable that all the yarns constituting the woven fabric or knitted fabric are high twisted yarns, since a high strength can be manifested. The high twisted yarns can also have a polyvinyl alcohol based size or acrylic size applied.

The fibers constituting the woven fabric or knitted fabric can be made of a polyester, polyamide, polyethylene, polypropylene or any of their copolymers.

Above all, it is preferable to use any one or more of polyesters, polyamides and their copolymers. It is especially preferable to use a polyester or co-polyester since the caustic reduction treatment can be effected and since the hand of the product can be easily adjusted.

To soften the artificial leather in hand, it is also preferable that the fibers constituting the woven fabric or knitted fabric are conjugate fibers which allows its at least one component to be dissolved away or which can be peeled or split by heat treatment or mechanical treatment, etc., and are integrally entangled with the web of ultra-fine fibers or conjugate fibers, being made ultra-fine before or after applying the elastic polymer.

When the yarns constituting the woven fabric or knitted fabric are conjugated fibers, the sectional form of the fibers is not especially limited. However, it is preferable that the yarns constituting the woven fabric or knitted fabric are islands-in-sea type conjugate fibers with an alkali soluble polymer as the sea component, and especially that the alkali soluble polymer is a co-polyester mainly composed of terephthalic acid and ethylene glycol, and containing 6 to 12 mol % of 5-sodiumsulfoisophthalic acid and/or 0 to 10 mol % of isophthalic acid, respectively based on the total amount of the acids.

It is preferable that the average fiber diameter of the single fibers constituting the woven fabric or knitted fabric is 1 μm to 30 μm. A more preferable range is 2 μm to 15 μm. It is preferable that the average yarn diameter of the yarns constituting the woven fabric or knitted fabric is 30 μm to 150 μm. A more preferable range is 50 μm to 120 μm.

If the average fiber diameter of the single fibers is less than 1 μm, the strength is likely to decline though it is preferable for softening the product. On the other hand, if the diameter is more than 30 μm, the reverse trend is likely to occur. If the average yarn diameter of the yarns is less than 30 μm, the woven fabric or knitted fabric is likely to be wrinkled when integrated with the web, and if more than 150 μm, the woven fabric or knitted fabric is poorly integrated with the web, and is likely to peel.

In the present invention the fiber-entangled substrate to which the elastic polymer is applied can be a fiber-entangled substrate of ultra-fine fibers or an integrated fiber-entangled substrate consisting of ultra-fine fibers and a woven fabric or knitted fabric as described before. Furthermore, it can be a fiber-entangled substrate of conjugate fibers or an integrated fiber-entangled substrate consisting of conjugate fibers and a woven fabric or knitted fabric, or an integrated fiber-entangled substrate consisting of conjugate fibers and a woven fabric or knitted fabric formed by conjugate fibers. Furthermore, after substantially solidifying the elastic polymer applied to any of these fiber-entangled substrates, a solvent not capable of dissolving the elastic polymer can be used to make the conjugate fibers ultra-fine preferably since the product can be softened and thinned.

The process of making fibers ultra-fine after applying the elastic polymer also includes the idea of impregnating the ultra-fine fiber-entangled substrate with the elastic polymer in the present invention.

The elastic polymers which can be used in the present invention include polyurethane elastomers, acrylonitrile-butadiene rubber, butadiene rubber, natural rubber, polyvinyl chloride, polyamides, etc.

Above all, a polyurethane elastomer is preferable in view of processability in the production of the nubuck-like artificial leather of the present invention, the grade of the final product, etc. It is especially preferable to use one or more in combination of polyester diol based polyurethanes, polyether diol based polyurethanes and polycarbonate diol based polyurethanes respectively with an average molecular weight of 500 to 3000. Furthermore, if caustic reduction treatment is effected as described later, a polyether diol based polyurethane or polycarbonate diol based polyurethane can be especially preferably used.

In the present invention, the fiber-entangled substrate is impregnated or coated with any of these elastic polymers, and causes the solvent of the elastic polymer to be removed, to substantially solidify the elastic polymer.

"Substantially solidifying the elastic polymer" means a state where even if the solvent partially remains in the elastic polymer, when the sheet is compressed to one half of the thickness and released, the elastic high polymer is not squeezed out together with the solvent.

When the elastic polymer is applied, the elastic polymer can contain, as required, such additives as a colorant, antioxidant, antistatic agent, dispersing agent, softening agent and coagulation regulator.

The sheet consisting of a fiber-entangled substrate and an elastic polymer obtained is then immersed in a solution containing a swelling agent for the elastic polymer, to swell the elastic polymer, and the sheet is compressed in the normal direction of the sheet.

For the above compression treatment, if the sheet is obtained by applying an elastic polymer to a fiber-entangled substrate of conjugate fibers or an integrated fiber-entangled substrate consisting of conjugate fibers and a woven fabric or knitted fabric or an integrated fiber-entangled substrate consisting of conjugate fibers and a woven fabric or knitted fabric formed by conjugate fibers, the conjugate fibers are made ultra-fine by using a solvent incapable of dissolving the elastic polymer, and the sheet is densified by pressurization using a roll, etc. with heating. Then, it is immersed in a solution containing a swelling agent for the elastic polymer, to swell the elastic polymer, and the sheet is compressed in the normal direction of the sheet. As another preferable method, the conjugate fibers without being made ultra-fine are immersed in a solution containing a swelling agent for the elastic polymer, to swell the elastic polymer, and the sheet is compressed in the normal direction of the sheet, the conjugate fibers being then made ultra-fine.

The swelling agent is a solvent good in affinity to water, and it is preferable to use the solvent after diluting it by water.

The preferable concentration of the solution containing the swelling agent is a concentration at which the elastic polymer is swollen without being dissolved, and has such an effect that when the sheet treated by the swelling agent is compressed to one half of the thickness and released, it restores its thickness up to 90% or less of the original thickness. The solvents which can be used here include dimethylformamide, dimethylacetamide, dimethyl sulfoxide, etc., and the swelling agent is obtained by properly diluting any of the solvents by water. The swelling agent concentration depends on the elastic polymer used in the fiber-entangled substrate, and cannot be specified generally. As a rule of thumb, it is preferable that the concentration is 60% or more, more preferably 80% or more. If the swelling agent concentration is less than 60%, the thickness reduction rate is too low, and the product is likely to be less dense. If the swelling agent concentration is too high, the elastic polymer is dissolved which lowers shape stability. The sheet immersion time in the swelling agent and the sheet compression ratio can be properly adjusted, considering the elastic polymer used, the amount of the elastic polymer deposited, etc.

According to various examinations by the inventors, when the sheet immersed in the swelling agent is compressed to ensure that the sheet thickness retaining rate with the sheet compressed in the normal direction of the sheet and solidified is in a range of 50% to 90% of the sheet thickness before immersion, generally good results can be obtained.

The technique of the present invention is different from any technique in which a sheet coated with a swelling agent solution by a gravure coater or spray coater, or a sheet with a swelling solution transferred from a releasing paper sheet coated on the surface with the swelling agent is nipped and heat-treated by hot air, etc. The technique of the present invention comprises the steps of substantially perfectly immersing the sheet into a swelling agent solution, nipping it in the immersion bath or after completion of immersion for compressing in the normal direction of the sheet, causing the swelling agent to be removed by an aqueous solvent, and drying in hot air, etc.

In the former coating or transfer method, only the elastic polymer near the surface layer is dissolved or swollen, and the swelling agent concentration is increased by hot air drying, to dissolve the elastic high polymer for filling the voids in the fibers of the fiber-entangled substrate. In general the dissolved elastic polymer is dry-formed into a film, for very strongly bonding the fibers and the elastic polymer together, to give a hard hand, and even slight shifting of raising treatment and slight fluctuation of sheet thickness are likely to greatly change the nap length and density, making quality control difficult.

On the contrary, in the latter method of the present invention, since the elastic polymer in the entire sheet is swollen, the density of the fiber-entangled substrate in the normal direction is likely to be uniform, and since the swelling agent is removed in an aqueous solvent for solidification, the elastic polymer is unlikely to fill the voids in the fibers. Furthermore, because of wet film formation, the problem of hard hand can be avoided.

Then, the sheet is raised at least on one side. If the sheet is an integrated fiber-entangled substrate combined with a woven fabric or knitted fabric, it is desirable to raise the fiber-entangled substrate on the side free from the woven fabric or knitted fabric. If the woven fabric or knitted fabric exists near the surface layer, it is desirable to lightly rub to such an extent that the woven fabric or knitted fabric may not be damaged.

The treatment for making fibers ultra-fine can also be effected after completion of raising treatment.

To further enhance the effect of the present invention, it is effective to ease the constraint at the base of the nap for making the nap less oriented.

Easing the constraint at the base of the nap for making the nap less oriented before or after raising treatment is directly effective since it especially lowers the R value (%), and is remarkably effective for softening the band and touch. It is especially effective to apply any treatment for caustic reducing ultra-fine fibers or to rub the entire napped fabric.

For example if a polyester or co-polyester is used as the polymer forming the ultra-fine fibers, it is effective to treat the ultra-fine fibers with an alkali for caustic reduction before or after fiber raising treatment. If a polyamide is used as the polymer forming the ultra-fine fibers, it is effective to rub physically.

Of course if a polyester or co-polyester is used as the polymer forming the ultra-fine fibers, it is also effective to rub the entire napped fabric in addition to the caustic reduction treatment.

The physical rubbing does not refer to any jigger method or thermosol method, but refers, for example, to rubbing by using a circular dyeing machine or a tumbler type rubbing machine, and such finishing treatment can provide a napped fabric with dense nap of short fibers and a softer hand.

The reduction rate by the caustic reduction can be decided in relation with the fineness of the ultra-fine fibers used, but it is preferable that the reduction rate is 1 to 30 wt % of the fiber. A more preferable range is 2 to 20 wt %, and a further more preferable range is 3 to 10%.

If the reduction rate is less than 1 wt %, the product is not sufficient in softness. If it is more than 30 wt % on the contrary, the strength of ultra-fine fibers declines. The caustic reduction can be achieved, for example, by applying hot water, warm water or size of caustic soda and subsequently steaming.

In setting the treatment conditions, it is essentially necessary to set up the alkali concentration and treatment time properly, in reference to the degradation of the elastic polymer. When the degradation of the elastic polymer is feared, it is desirable to use the alkali of lower concentration, but if there is no such fear, a higher concentration and higher temperature can also be used for the treatment.

In the caustic reduction treatment, if the fiber-entangled substrate is an integrated fiber-entangled substrate consisting of a nonwoven fabric of ultra-fine fibers and a woven fabric or knitted fabric, the integrated sheet can be made softer in hand by treating the ultra-fine fibers and/or the woven fabric or knitted fabric for caustic reduction. In this case, it is important that both or either of the ultra-fine fibers and the woven fabric or knitted fabric is formed by an alkali soluble polymer, i.e., a polyester or co-polyester. As described here, the caustic reduction treatment can improve not only the hand, but also the fiber separation among ultra-fine fibers, smoothness and touch of the fabric.

The caustic reduction treatment may degrade the elastic polymer. If the elastic polymer is a polyurethane elastomer, a polyester based polyurethane or polyester polyether diol based polyurethane can be used when the alkaline concentration is low, but it is preferable to use a polyether based polyurethane and/or a polycarbonate based polyurethane when it is intended to increase the reduction rate by increasing the alkali concentration.

As described above, the production process of the present invention can overcome the problem of the prior art that the hand becomes hard when the nap of the sheet is made denser and shorter in the raised fibers. Furthermore, the preferred embodiment can provide a more softened and smoother nubuck-like artificial leather.

The nubuck-like artificial leather obtained in the present invention has the nap of the less oriented fabric and can effectively improve the sewing yield not only in the clothing field, but also in the material fields of furniture, bags, shoes, car sheets, etc.

The product must be higher in strength in the material field than in the clothing field, and the nubuck-like artificial leather of the present invention can also meet such a demand. The felt was compacted, dried, provided with polyvinyl alcohol, and dried, and The present invention is described below in detail in reference to examples.

EXAMPLE 1

Islands-in-sea type conjugate fiber staples with polyethylene terephthalate as the island component, polystyrene as the sea component, islands/sea ratio of 30/70 wt %, 36 islands per filament, conjugate fiber fineness of about 4.4 dtex, fiber length of about 51 mm and about 12 crimps/in were formed into a web by a card and crosslapper, and the web was needle-punched to produce a felt with an areal unit weight of 790 g/m$^2$.

The felt was compacted, dried, provided with polyvinyl alcohol, and dried, and repetitively immersed in trichloroethylene and mangled by a mangle, to completely remove the polystyrene used as the sea component. The remaining felt was dried.

The obtained fiber-entangled sheet was a fiber-entangled substrate sheet in which about 0.04 dtex polyethylene terephthalate ultra-fine fibers of the island component were entangled.

The fiber-entangled sheet was impregnated with a polyester-polyether based polyurethane by about 30 parts as solid based on the amount of the fibers of the island component, and the polyurethane was wet-coagulated.

Then, the fiber-entangled sheet (about 1.5 mm thick) was substantially completely immersed in 90 wt % dimethylformamide aqueous solution, to swell the polyurethane, compressed at a clearance corresponding to one half of the original thickness, immersed in water, to remove the solvent, and dried, to obtain a sheet (about 1.2 mm thick) with an elastic polymer applied to an entangled substrate of polyethylene terephthalate ultra-fine fiber bundles with an average fiber fineness of about 0.04 dtex.

The sheet was cut half in the direction parallel to the surface (cut into two sheets with a thickness of one half), and the cut sheets were fiber-raised by 400-mesh sand paper on the cut surfaces, to produce a greige.

Then, the greige was supplied into a circular dyeing machine, treated by an alkali to achieve an ultra-fine fiber reduction rate of 4%, taken out of the circular dyeing machine, re-supplied into the circular dyeing machine in the reverse direction, dyed brown using a disperse dye, finish-treated, and rubbed while dried by a tumbler type rubbing machine, to obtain a nubuck-like artificial leather with an apparent density of 0.41 g/cm$^3$ and a nap length of about 0.5 mm.

The nubuck-like artificial leather was cut into a 5 cm long×5 cm wide piece, and brushed on the nap surface in the forward direction 5 times, and the nap surface was continuously rotated from 0 degree to 180 degrees by a goniophotometer, to measure the goniometric reflectance distribution.

The R value obtained from the goniometric reflectance distribution was 15%, and the two troughs in the change of the quantity of reflected light at about 90 degrees on the goniometric reflectance distribution were little observed as shown in FIG. 3.

Two 30 cm long×10 cm wide pieces of the nubuck-like artificial leather were sewn by a sewing machine in the longitudinal direction with one piece reversed 180 degrees, and the color shade difference of the nap surface was visually found to be very slight.

A lady's jacket sewn from the sheet had a good appearance of a nubuck-like artificial leather, and the sewing yield could be improved by about 20%.

EXAMPLE 2

A web formed by using the same islands-in-sea type conjugate fiber stables as used in Example 1 was overlaid on a plain weave fabric (with an areal unit weight of 70 g/m$^2$) formed by using falsely twisted gray yarns of 75D-72f polyethylene terephthalate fibers and 2500 T/m in the count of twist, and they were needle-punched, to prepare a fiber-entangled felt with an areal unit weight of 780 g/m$^2$.

Thereafter, by treatment under the same conditions as described for Example 1, a good nubuck-like artificial leather with an apparent density of 0.44 g/cm$^3$ and a nap length of 0.4 mm could be obtained, in which a polyurethane was applied to an integrated fiber-entangled substrate consisting of ultra-fine polyethylene terephthalate fiber bundles with an average fiber fineness of about 0.04 dtex and a woven fabric.

The R value obtained from the goniometric reflectance distribution of the nubuck-like artificial leather measured as described for Example 1 was 12%, and the two troughs in the change of the quantity of reflected light at about 90 degrees on the goniometric reflectance distribution were little observed as in Example 1.

The artificial leather was sewn by using a sewing machine as described for Example 1, and the color shade difference was visually found to be very slight.

EXAMPLE 3

Islands-in-sea type conjugate fiber stables with nylon 6 as the island component, polystyrene as the sea component, islands/sea ratio of 50/50 wt %, 36 islands, conjugate fiber fineness of about 3.3 dtex, cut length of about 51 mm and about 12 crimps/in were formed into a web by a card crosslapper, and the web was needle-punched, to produce a felt with an areal unit weight of 700 g/m$^2$.

The felt was treated to be shrunken, dried, have polyvinyl alcohol applied, and dried, and repetitively immersed in trichloroethylene and mangled by a mangle, to completely remove the polystyrene used as the sea component. The remaining felt was dried.

The obtained fiber-entangled sheet was an ultra-fine fiber-entangled sheet in which about 0.05 dtex nylon 6 ultra-fine fibers of the island component were entangled.

The fiber-entangled sheet was impregnated with a polyester-polyether based polyurethane by about 35 parts as solid based on the amount of the fibers of the island component, and the polyurethane was wet-coagulated.

Then, the fiber-entangled sheet (about 1.3 mm thick) was substantially completely immersed in 85 wt % dimethylformamide aqueous solution, to swell the polyurethane, compressed at a clearance corresponding to about one half of the original thickness, immersed in water, desolvated, and dried to obtain a sheet (about 1.0 mm thick) in which an elastic polymer was applied to a fiber-entangled substrate of ultra-fine nylon 6 fiber bundles with an average fiber fineness of about 0.05 dtex.

The sheet was cut half in the direction parallel to the surface (cut into two sheets with a thickness of one half), and the cut sheets were raised using 400-mesh sand paper on the cut surfaces, to produce a greige.

The greige was supplied into a circular dyeing machine, treated by hot water, taken out of the circular dyeing machine, re-supplied into the circular dyeing machine in the reverse direction, dyed brown using a metal-containing acid dye, finish-treated, and rubbed while dried by a tumbler type rubbing machine, to obtain a nubuck-like artificial leather with an apparent density of 0.45 g/cm$^3$ and a nap length of about 0.4 mm.

The nubuck-like artificial leather was cut into a 5 cm long×5 cm wide piece, and the piece was rubbed on the nap surface in the forward direction by brushing 5 times, and the nap surface was continuously rotated from 0 degree to 180 degrees by a goniophotometer to measure the goniometric reflectance distribution.

The R value obtained from the goniometric reflectance distribution was 17%, and the two troughs in the change of the quantity of reflected light at about 90 degrees on the goniometric reflectance distribution were little observed as shown in FIG. 3.

Two 30 cm long×10 cm wide pieces taken from the nubuck-like artificial leather were sewn together by a sewing machine in the longitudinal direction with one piece reserved 180 degrees, and the color shade difference of the nap surface was visually found to be very slight.

EXAMPLE 4

Islands-in-sea type conjugate fiber stables with nylon 6 as the island component, a polyester with 5-sodiumsulfoisophthalate copolymerized by 5.2 mol % based on the total amount of the acids as the sea component, islands/sea ratio of 50/50 wt %, 36 islands, conjugate fiber fineness of about 4.4 dtex, cut length of 51 mm and about 12 crimps/in were formed into a web by a card crosslapper, and the web was needle-punched to produce a felt with an areal unit weight of 600 g/m$^2$. The felt was treated to be shrunken and dried. The sheet was impregnated with a dimethylformamide based and polyether based polyurethane by about 45 parts as solid based on the amount of the fibers of the island component, and the polyurethane was wet-coagulated.

Then, the sheet was immersed in 90 wt % dimethylformamide aqueous solution, compressed at a clearance corresponding to about one half of the thickness, immersed in water to remove the solvent, and dried. The sheet was repetitively immersed in 3 wt % caustic soda solution at 98° C. for 40 minutes and mangled by a mangle, and neutralized by acetic acid, washed by water and dried, to obtain a sheet with a polyurethane applied to a fiber-entangled substrate of ultra-fine nylon fibers with a fiber fineness of about 0.06 dtex. The sheet was cut half in the direction parallel to the surface, and the cut sheets were raised on the cut surfaces by 400-mesh sand paper, to produce a greige.

The greige was supplied into a circular dyeing machine, dyed and finished as described for Example 3, to obtain a nubuck-like artificial leather with an apparent density of 0.44 g/cm and a nap length of 0.4 mm.

The nubuck-like artificial leather was measured by a goniophotometer as described for Example 1, to obtain the goniometric reflectance distribution.

The R value obtained from the goniometric reflectance distribution was 19%, and the two troughs in the change of the quantity of reflected light at about 90 degrees on the goniometric reflectance distribution were little observed as shown in FIG. 3. The color shade difference of the nap surface of the artificial leather pieces sewn together by a sewing machine as described for Example 1 was found to be very slight.

EXAMPLE 5

Islands-in-sea type conjugate fiber staples with polyethylene terephthalate as the island component, polystyrene as the sea component, islands/sea ratio of 55/45 wt %, 36 islands, conjugate fiber fineness of about 4.4 dtex, cut length of about 51 mm and about 12 crimps/in were formed into a web by a card crosslapper, and the web was needle-punched, to produce a felt with an areal unit weight of 570 g/m$^2$. The felt was treated to be shrunken and dried. The sheet was impregnated with a solution having polyester-polyether based polyurethane dissolved in dimethylformamide/water= 92/8 wt %, by about 30 parts as solid based on the amount of the fibers of the island component, and the polyurethane was wet-coagulated. The sheet was immersed in trichloroethylene, mangled to remove the sea component, dried, and heat-pressed by a press roll, to achieve an apparent density of 0.4 g/cm$^3$ in the fibers of the island component.

The sheet was then immersed in 90 wt % dimethylformamide aqueous solution, compressed, immersed in water to remove the solvent, and dried, to obtain a sheet with an elastic polymer applied to a fiber-entangled sheet of ultra-fine polyethylene terephthalate fibers with a fiber fineness of about 0.08 dtex. The obtained sheet was cut half, and the cut sheets were raised by 400-mesh sand paper on the cut surfaces, to produce a greige.

The greige was supplied into a circular dyeing machine, dyed and finished as described for Example 1, to obtain a nubuck-like artificial leather with an apparent density of 0.49 g/cm$^3$ and a nap length of 0.4 mm.

The nubuck-like artificial leather was measured by a goniophotometer as described for Example 1, to obtain the goniometric reflectance distribution.

The R value obtained from the goniometric reflectance distribution was 16%, and the two troughs in the change of the quantity of reflected light at about 90 degrees on the goniometric reflectance distribution were little observed as shown in FIG. 3. Furthermore, the color shade difference on the nap surface of the artificial leather pieces sewn together by a sewing machine as described for Example 1 was found to be very slight.

COMPARATIVE EXAMPLE 1

Islands-in-sea type conjugate fiber staples with polyethylene terephthalate as the island component, polystyrene as the sea component, islands/sea ratio of 80/20 wt %, 16 islands, conjugate fiber fineness of about 4.4 dtex, cut length of about 51 mm and about 12 crimps/in were formed into a web by a card crosslapper, and the web was needle-punched to produce a fiber-entangled felt with an areal unit weight of 520 g/m$^2$.

The felt was compacted, dried, provided with polyvinyl alcohol, dried, and repetitively immersed in trichloroethylene and mangled by a mangle, and dried, to obtain an ultra-fine fiber-entangled sheet.

The sheet was impregnated with a polyester-polyether based polyurethane by about 30 parts as solid based on the amount of the fibers of the island component, and the polyurethane was wet-coagulated. The sheet was desolvated and dried, to obtain a sheet with an elastic polymer applied to a fiber-entangled substrate of ultra-fine polyethylene terephthalate fiber bundles with an average fiber fineness of about 0.23 dtex.

The sheet was cut half, and the cut sheets were raised by 240-mesh sand paper on the cut surfaces, to produce a greige.

The greige was supplied into a circular dyeing machine, dyed brown using a disperse dye, and finished, to obtain an artificial leather with an apparent density of 0.25 g/cm$^3$ and a nap length of about 0.9 mm.

The R value of the artificial leather obtained from the goniometric reflectance distribution measured as described for Example 1 was 37%, and the two troughs in the change of the light of reflected light at about 90 degrees on the reflectance distribution were conspicuous as shown in FIG. 2. The visually evaluated color shade difference of the artificial leather pieces sewn together by a sewing machine as described for Example 1 was large.

COMPARATIVE EXAMPLE 2

The sheet of Example 5 impregnated with a polyurethane, having it wet-coagulated, immersed in trichloroethylene, mangled to remove the sea component and dried was heat-pressed, immersed in 90 wt % dimethylformamide aqueous solution and cut half without being compressed. The cut sheets were raised by 240-mesh sand paper on the cut surfaces, to produce a greige.

The greige was supplied into a circular dyeing machine, dyed and finished as described for Example 5, to obtain an artificial leather with an apparent density of 0.29 g/cm$^3$ and a nap length of about 1.0 mm.

The R value of the artificial leather obtained from the goniometric reflectance distribution measured as described for Example 1 was 31%, and the two troughs in the change of the quantity of reflected light at about 90 degrees on the reflection distribution were conspicuous as shown in FIG. 2. The visually evaluated color shade difference of the artificial leather pieces sewn together by a sewing machine as described for Example 1 was large.

INDUSTRIAL AVAILABILITY

The artificial leather obtained according to the present invention has a new nubuck-like look and hand, and is widely acceptable in the fields of high quality fashion, car sheets, interior, furniture, etc.

What is claimed is:

1. A process for producing a nubuck-like artificial leather, in which a sheet obtained by applying an elastic polymer to an ultra-fine fiber-entangled substrate is raised to produce a napped sheet, comprising the steps of applying an elastic polymer to an ultra-fine fiber-entangled substrate, substantially solidifying the elastic polymer, immersing the polymer-deposited fiber-entangled substrate into a swelling agent of the elastic polymer to swell the elastic polymer, compressing the sheet in the normal direction of the sheet, removing the swelling agent by an aqueous solvent, and raising the sheet at least on one side.

2. A process for producing a nubuck-like artificial leather, according to claim 1, wherein a polyester or co-polyester is used as the polymer forming the ultra-fine fibers, and the caustic reduction treatment of the ultra-fine fibers is effected after raising.

3. A process for producing a nubuck-like artificial leather, according to claim 1, wherein a polyamide is used as the polymer forming the ultra-fine fibers, and physical rubbing is effected after raising.

4. A process for producing a nubuck-like artificial leather, according to any one of claims 1 through 2, wherein the ultra-fine fiber-entangled substrate used in the artificial leather is an integrated fiber-entangled substrate comprising ultra-fine fibers and a woven fabric or knitted fabric.

5. A process for producing a nubuck-like artificial leather, according to claim 1, wherein after the sheet is immersed in a swelling agent, compressed in the normal direction of the sheet and solidified, the sheet thickness holding rate is in a range from 50% to 90% based on the thickness of the sheet before immersion.

6. A process for producing a nubuck-like artificial leather, according to claim 4, wherein at least a part of the yarns forming the woven fabric or knitted fabric are high twisted yarns of 500 T/m to 4500 T/m.

* * * * *

UNITED STATES PATENT AND TRADEMARK OFFICE

CERTIFICATE OF CORRECTION

PATENT NO. : 6,780,469 B2
DATED : August 24, 2004
INVENTOR(S) : Iijima et al.

It is certified that error appears in the above-identified patent and that said Letters Patent is hereby corrected as shown below:

Column 3,
Line 66, please change "25 mm" to -- 25 $mm^2$ --.

Column 5,
Line 46, please change "12 molt" to -- 12 mol% --.

Column 12,
Lines 60 and 61, please delete "The felt was compacted, dried, provided with polyvinyl alcohol, and dried, and".

Column 18,
Line 13, please change "A process for producing a nubuck-like artificial leather, according to claim 1, wherein a polyester or co-polyester is used as the polymer forming the ultra-fine fibers, and the caustic reduction treatment of the ultra fine fibers is effected after raising" to -- The process according to claim 1, further comprising subjecting the ultra-fine fibers to a caustic reduction treatment after raising and wherein the ultra-fine fibers are formed from polyester or co-polyester --;
Line 18, please change "A process for producing a nubuck-like artificial leather, according to claim 1, wherein a polyamide is used as the polymer forming the ultra-fine fibers, and physical rubbing after raising and wherein the ultra-fine fibers are formed from polyamide --; at line 22, please change "A" to -- The -- and delete, "for producing a nubuck-like artificial leather,"; at lines 24 and 25, please delete "used in the artificial leather"; at line 27, please change "A" to -- The -- and please delete "for producing a nubuck-like artificial leather,"; and at line 33, please change "A" to -- The -- and delete "for producing a nubuck-like artificial leather".

Signed and Sealed this

Fifth Day of April, 2005

JON W. DUDAS
*Director of the United States Patent and Trademark Office*